United States Patent [19]

LaPan

[11] 4,178,029

[45] Dec. 11, 1979

[54] FERROUS OBJECT RETRIEVER

[76] Inventor: LeRoy A. LaPan, 1913 24th St., Bay City, Mich. 48706

[21] Appl. No.: 880,325

[22] Filed: Feb. 22, 1978

[51] Int. Cl.[2] ..... B66C 1/04

[52] U.S. Cl. ..... 294/65.5

[58] Field of Search ..... 294/65.5, 19, 24, 23, 294/22, 21, 20; 16/138, 139, 140, 141; 233/135, 130, 106

[56] References Cited

U.S. PATENT DOCUMENTS

| | | | |
|---|---|---|---|
| 2,970,002 | 1/1961 | Laviano | 294/65.5 |
| 3,297,352 | 1/1967 | Larrison et al. | 294/65.5 |
| 3,789,336 | 1/1974 | Gordin | 294/65.5 |

*Primary Examiner*—James B. Marbert

*Attorney, Agent, or Firm*—Clarence A. O'Brien; Harvey B. Jacobson

[57] ABSTRACT

An elongated handle is provided including an endwise outwardly projecting elongated permanent magnet embedded in and projecting lengthwise outwardly from one end of the handle. A hollow cap is provided and is removably telescopingly engageable over the end of the handle from which the permanent magnet projects and the cap loosely encloses the outwardly projecting end of the magnet. The cap is removable from the end of the handle from which the magnet projects and is, alternately, removably telescopingly engageable over the remote end of the handle for storage thereon and as use as a handgrip for the handle when the permanent magnet is to be exposed and the handle is to be utilized in retrieving a ferrous object which may not otherwise be retrieved.

2 Claims, 4 Drawing Figures

FERROUS OBJECT RETRIEVER

BACKGROUND OF THE INVENTION

When persons perform canning operations metallic objects are often inadvertently dropped into pots or kettles of hot liquids. Such objects may include canning lids, spoons, forks, and other metallic objects. If the associated pot or kettle is at that time being utilized for canning operations, it is, in many instances, very time consuming and substantially impossible to remove metallic objects dropped into the hot liquids in the kettle or pot. If the dropped object comprises a flat canning lid, there are substantially no article-gripping tools available which may be utilized to recover the lid from the pot. Also, there are other metallic objects which are difficult to remove with plier or clamp-type tools. Accordingly, a need exists for a tool which may be utilized in retrieving metallic objects dropped into pots or kettles of hot liquids.

Also, many small metallic objects are dropped in locations in which the dropped objects may be obscured. Such locations include lawn areas covered with grass and high pile shag carpets. Therefore, a need also exists for providing a tool to assist in locating small objects from visually obscured positions.

Various forms of magnetic hand manipulatable pick-up tools have been heretofore provided. However, most of these tools include magnetic portions which are continuously exposed and which, therefore, tend to be magnetically attracted to any adjacent ferrous objects. For this reason, a need further exists for a magnetic pick-up tool including a removable cover for the otherwise exposed magnetic portion thereof. Further, inasmuch as removable covers for tools may be lost or misplaced during use of the tool when the cover is removed, still another need exists for a magnetic tool including storage means for a removable cover positionable over the otherwise exposed magnetic portion of the tool.

Various forms of magnetic pick-up tools including some of the general structural and operational features of the instant invention are disclosed in U.S. Pat. Nos. 2,471,764 2,873,136, 2,970,002, 2,993,723, 3,169,791 and 3,582,123.

BRIEF DESCRIPTION OF THE INVENTION

The magnetic pick-up tool of the instant invention includes an elongated handle portion constructed of hard wood or other materials including similar durability characteristics and one end of the handle is provided with a longitudinal blind bore formed therein in which one end portion an elongated permanent magnet is secured with the other end of the permanent magnet projecting endwise outwardly from the corresponding end of the handle. A hollow closure cap is removably telescopingly engageable over the end of the handle from which the permanent magnet is supported and the end cap is also removably positionable over the opposite end of the handle when the tool is in use and for storing the end cap against loss or accidental misplacement during use of the tool.

The main object of this invention is to provide a magnetic tool for retrieving ferrous articles from various locations.

Another object of this invention is to provide an elongated tool having one end thereof defining a handle and with an exposed permanent magnet supported from the other end thereof whereby the tool may be utilized to magnetically retrieve ferrous articles from environments rendering them irretrievable by human hand.

Still another object of this invention is to provide a magnetic tool for retrieving ferrous articles and constructed in accordance with the preceding objects and further provided with a removable cap for telescopic engagement over the end of the tool from which the permanent magnet is supported and which is also telescopically engageable over the opposite end of the tool for storage of the cap and to define a handgrip for the tool when the tool is in use with the permanent magnet portion thereof in a fully exposed position.

A final object of this invention to be specifically enumerated herein is to provide a tool in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
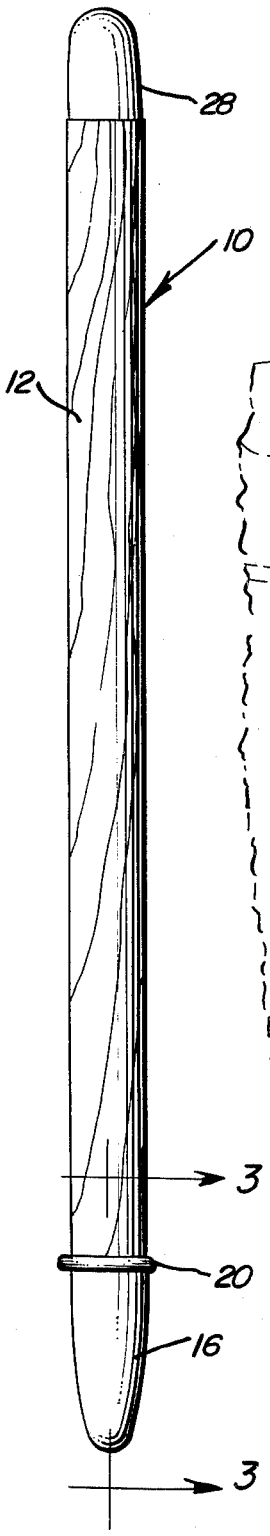
FIG. 1 is a side elevational view of the tool of the instant invention.

Referring now more specifically to the drawings, the numeral 10 generally designates the tool of the instant invention. The tool 10 includes an elongated generally cylindrical handle 12 constructed of hardwood or other material including similar durability characteristics. One end of the handle 12 includes a slightly diametrically reduced end portion 14 over which a hollow cap structure 16 is removably telescopingly engaged with the inner closed end 18 of the cap structure 16 spaced endwise outwardly of the corresponding terminal end of the handle 12. The open end of the cap 16 includes a radially outwardly projecting and circumferentially extending rib 20 and the handle 12 includes a blind bore 22 of non-circular cross-sectional shape formed in the terminal end thereof. An elongated permanent magnet 24 has one end thereof seatingly telescoped and secured in the bore 22 and the permanent magnet is generally rectangular in cross-sectional shape and conforms to the cross-sectional shape of the bore 22.

One end of the permanent magnet 24 projects endwise outwardly from the associated terminal end 26 of the handle 12 and the end cap 16 loosely encloses the outwardly projecting end of the permanent magnet 24 when the cap 16 is telescoped over the diametrically reduced end portion 14.

The end of the handle 12 remote from the diametrically reduced end portion 14 includes a second diametrically reduced end portion 28 over which the end cap 16 is also removably telescopingly engaged. Accordingly, when the end cap 16 is removed from from the diametrically reduced end portion 14, it may be removably telescoped over the diametrically reduced end portion 28 for storage thereon against loss or accidental misplacement.

When the end cap 16 is removed from the end portion 14 and telescopingly engaged over the end portion 28, the end cap 16 defines a handgrip for the end of the handle 12 remote from the diametrically reduced end portion 14. In addition, when the end cap 16 is removed from the diametrically reduced end 14, the permanent magnet 24 is exposed and may, therefore, be utilized to magnetically attract ferrous objects.

Figure 2:
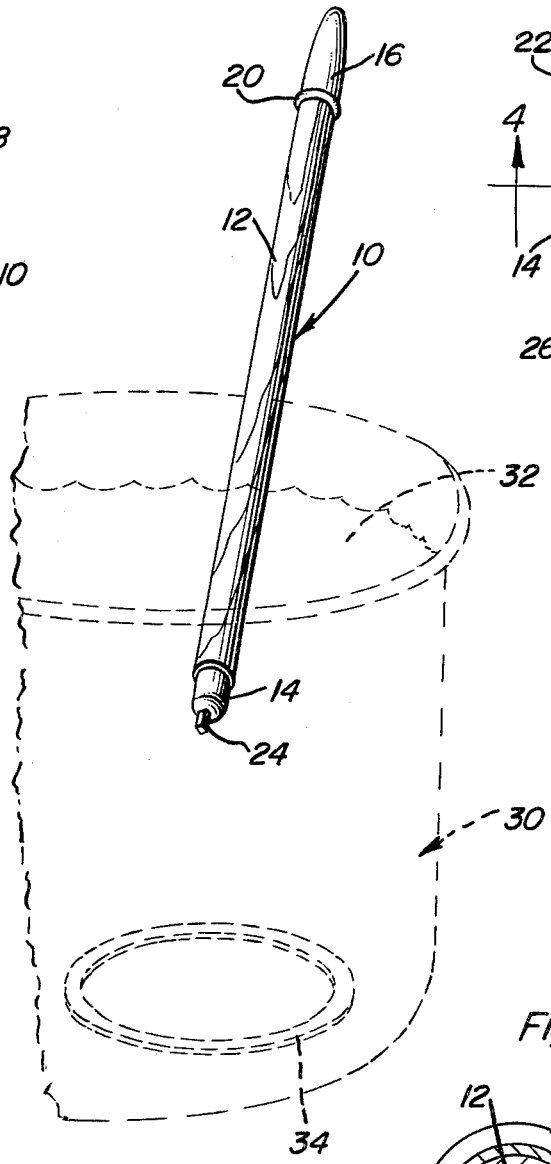
FIG. 2 is a perspective view of the tool with the removable cap portion thereof telescopingly engaged with the end of the handle portion of the tool remote from the exposed permanent magnet and comprising a handgrip for the handle.
Figure 3:
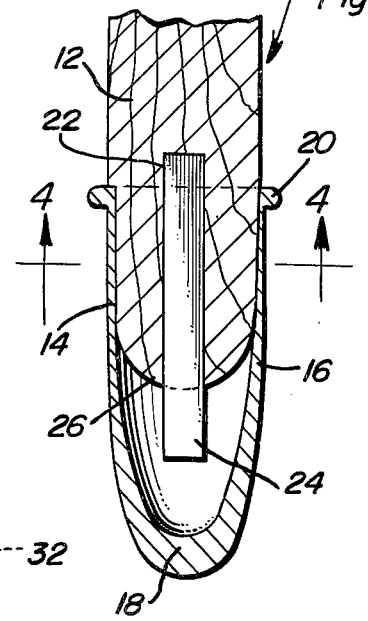
FIG. 3 is an enlarged, fragmentary, vertical, sectional view taken substantially upon the plane indicated by the section line 3—3 of FIG. 1.
Figure 4:
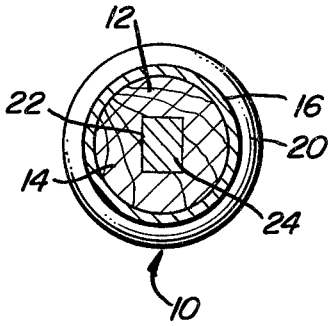
FIG. 4 is a fragmentary, horizontal, sectional view taken substantially upon the plane indicated by the section line 4—4 of FIG. 3.

With attention now invited more specifically to FIG. 2 of the drawings, a large capacity pot or kettle is generally designated by the reference numeral 30 and the end portion 14 of the handle 12 may be depressed down into the hot liquid 32 within the kettle 30 in order to retrieve a ferrous object 34 from the bottom of the kettle 30. Inasmuch as most canning pots and kettles are constructed of aluminum, the magnet 24 will encounter little difficulty in magnetically attracting a ferrous object from the bottom of the pot 30. In this manner, the tool 10 may be readily utilized to retrieve ferrous objects from the bottom of a canning pot or kettle.

it is also pointed out that the tool 10 may be utilized to magnetically retrieve small ferrous objects which are dropped and obscured in high pile shag rugs and grassy lawn areas. Further, the tool 10 may also be utilized in other environments to retrieve ferrous objects.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A tool especially designed to be used in a kitchen for retrieving ferrous objects, said tool comprising an elongated wooden handle including opposite ends, one of said ends including a diametrically reduced end portion having an endwise outwardly opening blind bore formed therein, an elongated permanent magnet having one end seated and secured in said bore with the other end of the magnet projecting endwise outwardly of said end portion, a hollow end cap removably engaged over said end portion and loosely enclosing the exposed end of said permanent magnet therein, the other end of said handle being of substantially the same cross-sectional shape and size as said end portion of said handle and said cap, when removed from said one end portion of said handle, may be removably snugly telescopingly engaged over the other end of said handle and comprise a handgrip for the last mentioned end of said handle.

2. The combination of claim 1 wherein said other end of said handle also includes a diametrically reduced end portion.

* * * * *